United States Patent [19]

Wedhorn

[11] Patent Number: 4,872,581

[45] Date of Patent: Oct. 10, 1989

[54] KNOCK-DOWN BOOM FOR PICK-UP TRUCK

[76] Inventor: Norman G. Wedhorn, 44112 Yost, Canton, Mich. 48188

[21] Appl. No.: 123,334

[22] Filed: Nov. 20, 1987

[51] Int. Cl.[4] ..... B66C 23/44

[52] U.S. Cl. ..... 212/180; 212/182; 212/187; 414/542

[58] Field of Search ..... 212/175, 180, 186, 187, 212/188, 241, 244, 255, 258, 260, 261, 262, 263, 265, 266; 414/542, 560, 563

[56] References Cited

U.S. PATENT DOCUMENTS

| | | | |
|---|---|---|---|
| 1,641,351 | 9/1927 | Nilson | 414/563 |
| 1,856,082 | 5/1932 | Remde | 212/244 |
| 2,072,398 | 3/1937 | Faulk | 212/180 |
| 2,190,258 | 2/1940 | Colorigh | 212/180 |
| 2,261,478 | 11/1941 | Tourneau | 212/175 |
| 3,593,865 | 7/1971 | Moor | 414/563 |
| 3,613,918 | 10/1971 | Kruschke | 414/542 |
| 4,049,238 | 9/1977 | Brown | 414/563 |
| 4,087,008 | 5/1978 | Silva | 414/563 |
| 4,216,941 | 8/1980 | Little | 414/563 |
| 4,269,396 | 5/1981 | Easterwood | 414/563 |
| 4,383,791 | 5/1983 | King | 414/542 |

FOREIGN PATENT DOCUMENTS

| | | | |
|---|---|---|---|
| 612950 | 2/1934 | Fed. Rep. of Germany | 414/542 |
| 727370 | 10/1942 | Fed. Rep. of Germany | 212/182 |
| 994393 | 2/1983 | U.S.S.R. | 212/262 |
| 1092066 | 5/1984 | U.S.S.R. | 414/542 |
| 629178 | 9/1949 | United Kingdom | 212/180 |
| 2173473 | 10/1986 | United Kingdom | 212/258 |

*Primary Examiner*—Sherman D. Basinger
*Assistant Examiner*—Thomas J. Brahan
*Attorney, Agent, or Firm*—Charles W. Chandler

[57] ABSTRACT

A knock-down boom is removably installed on a pick-up truck so as to be manually raised or lowered for moving a load either onto or off the truck. The boom can be readily disassembled in a few minutes by separating the legs forming the boom and storing them in a convenient compact area. A jib can also be mounted on the outer end of the boom for extending its overall length.

5 Claims, 3 Drawing Sheets

KNOCK-DOWN BOOM FOR PICK-UP TRUCK

BACKGROUND OF THE INVENTION

This invention is related to a knock-down boom adapted to be mounted on a pick-up truck. The boom can be easily disassembled in a few minutes for storage in a compact location.

Collapsible booms for trucks which can be collapsed when the truck is being relocated are known in the art. An example is to be found in U.S. Pat. No. 2,687,809 which issued to Roy O. Balogh on Aug. 31, 1954.

Collapsible booms of the type illustrated by Balogh are usually pivoted toward a transport position for relocating the boom with the truck. However, the boom typically remains in a fully assembled position and occupies a substantial portion of the truck even though not in use.

SUMMARY OF THE INVENTION

The broad purpose of the present invention is to provide a knock-down boom for a pick-up truck comprising a pair of boom legs having their lower ends pivotally connected to opposite sides of the truck bed, adjacent the tailgate, and their upper ends fastened together to support a load-carrying device, such as a chain fall. A combination cable and chain are connected between the truck cargo box and the upper end of the boom. One man can readily swing the boom between an inboard position and an outboard position by manipulating a chain-come-along.

In another embodiment of the invention, a jib is mounted on the upper end of the boom to form an extension of the boom.

The preferred embodiment of the invention comprises a relatively few components which can be easily separated from the truck bed and stored in an out-of-the-way position. The boom legs can be readily raised and lowered without any external power means. The boom can be swung fully inboard and laid in a position adjacent the wheel wells.

The boom can be mounted on any stable platform such as a wagon, a trailer or the like. It can be clamped on a rear bumper for rental or temporary use.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
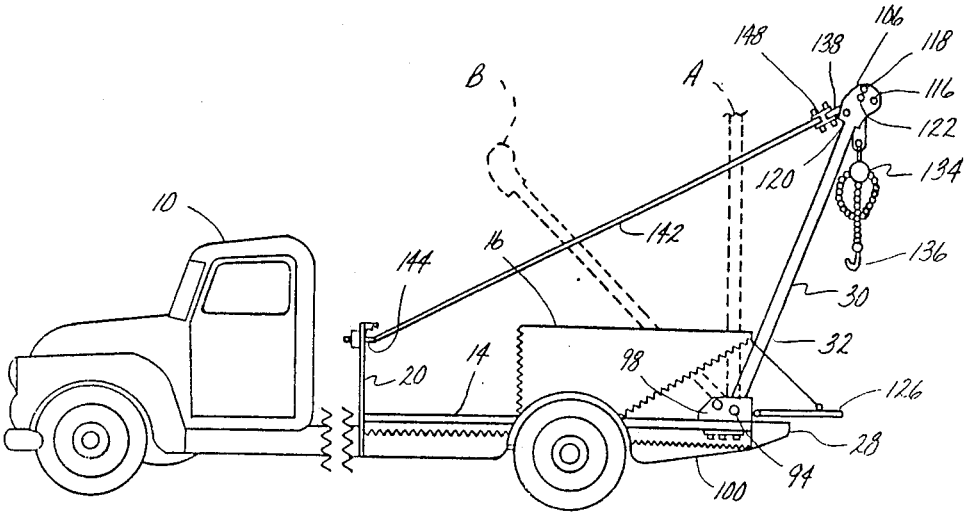
FIG. 1 is an elevational, partially fragmentary view of a knock-down boom, illustrating the preferred embodiment of the invention, mounted on a pick-up truck bed.
Figure 2:
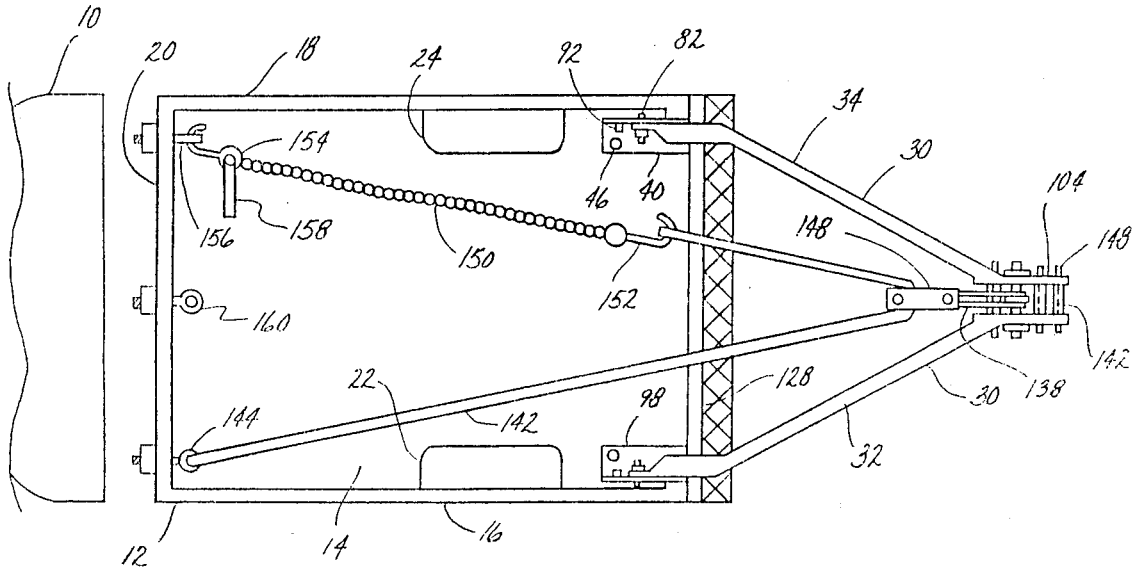
FIG. 2 is a plan view of the pick-up truck and knock-down boom of FIG. 1.

Referring to FIGS. 1 and 2 of the drawings, a conventional pick-up truck 10 is illustrated as having a cargo box 12 having a bed 14, a pair of sidewalls 16 and 18 and a forward wall 20. The cargo box includes wheel wells 22 and 24. The cargo box has tailgate 26 and rear step bumper 28.

Figure 4:
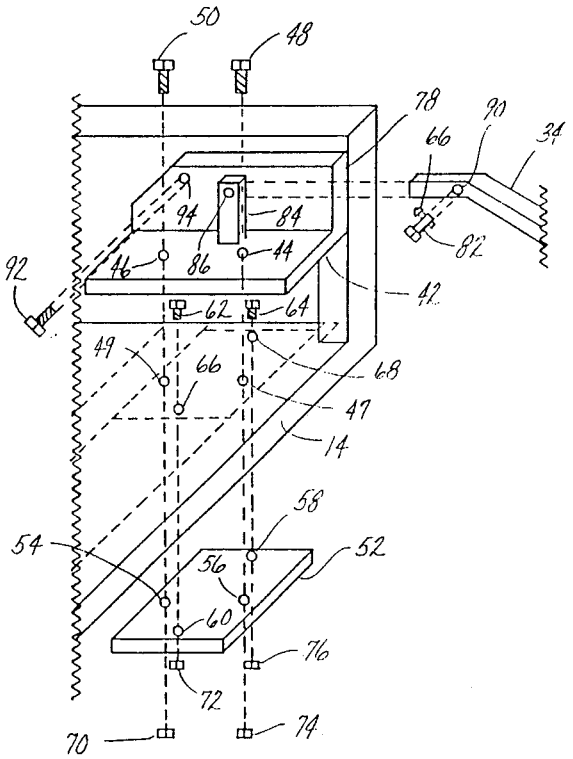
FIG. 4 is an exploded view illustrating the manner in which the boom legs are fastened to the truck bed.

A preferred knockdown boom 30 includes a pair of elongated boom legs 32 and 34. The lower ends of the two legs are pivotally connected to the truck bed 14, adjacent sidewalls 16 and 18 and tailgate 26. Each of the legs has a generally tubular construction. The lower leg ends are mounted on foot structures that include structural angles 40 and 98, respectively. The structural angles are identical to one another except for a right and left hand relationship. Structural angle 40 is illustrated in greater detail in FIG. 4.

Figure 5:
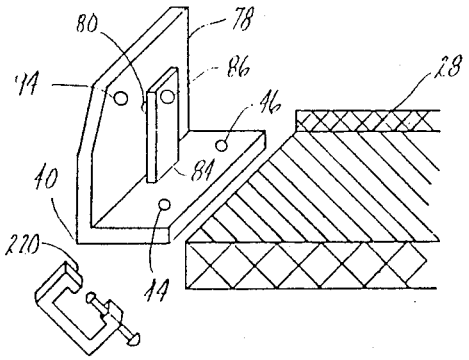
FIG. 5 is a view illustrating the manner in which a boom leg can be clamped to the truck rear bumper.

Structural angle 40 is mounted on truck bed 14 as in FIGS. 2 and 5. Angle 40 has a horizontal wall 42 having a pair of fastener-receiving openings 44 and 46. Fastener means 48 and 50 are passed through openings 44 and 46, respectively, and through an aligned pair of openings 47 and 49 in the truck bed.

A plate 52, is mounted beneath truck bed 14 between support members of the bed (not shown), so that the truck bed is sandwiched between plate 52 and structural angle 40. Plate 52 has a pair of openings 54 and 56 for receiving fastener means 50 and 48 respectively, for fastening the plate and the structural angle to the truck bed. Plate 52 has openings 58 and 60 for receiving fasteners 62 and 64 through openings 66 and 68 in the trunk bed for fastening plate 52 to the underside of the bed.

Fastener 50 engages nut 70. Fastener 48 engages nut 74. Fastener 62 engages nut 72, and fastener 64 engages nut 76.

Referring to FIG. 5, structural angle 40 also has a vertical wall 78 with an opening 80 for a pin 82. The angle has an upstanding sectional wall 84 with opening 86. The lower end of leg 34 is inserted between vertical wall 78 and wall 84. Pin 82 is inserted through opening 86, opening 90 in leg 34, and opening 80, shown in FIG. 5, for pivotally pinning the leg to the truck bed so that the boom leg is moveable between an outboard position, illustrated in FIG. 1, to a vertical position illustrated at "A" in phantom, and an inboard position illustrated at "B" in phantom.

A stop bolt 92 is mounted in threaded opening 94 in the vertical wall of the structural angle, forward of the lower end of leg 34 to function as a stop member, that is to say, that stop bolt 92 provides means for limiting the inboard motion of the boom leg.

Figure 3:
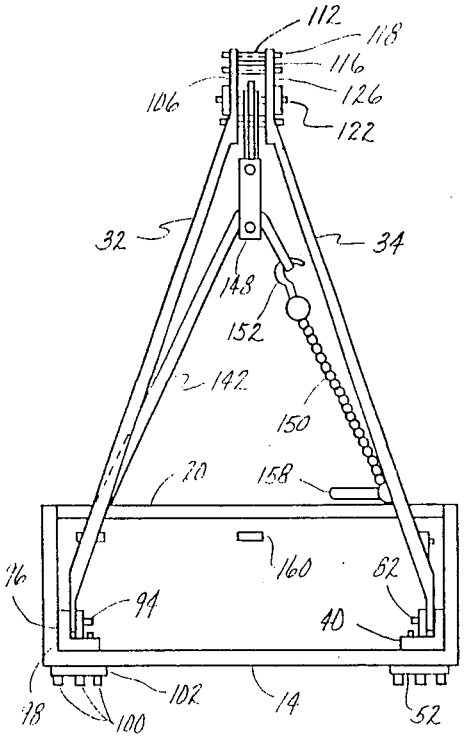
FIG. 3 is a rear view of the cargo box and knock-down boom.

Referring to FIG. 3 the lower end of leg 32 is pivotally connected by a pin 94 to the vertical wall 96 of structural angle 98. Angle 98 is fastened by fastener means 100 to plate 102 mounted beneath the trunk bed in a manner similar to that of the connection of the lower end of leg 34 to the truck bed.

FIG. 5 illustrates a manner for temporarily mounting the boom on truck bumper 28 by moving angle 40 from the right side of the truck bed to the left side, and reversing it end for end. Angle 98 is relocated to the right side and reversed, end for end, in the same manner.

Clamp 220 provides means for temporarily anchoring the structural angle to the truck step bumper without drilling any holes in the truck bumper, which is useful for a rental operation.

Figure 6:
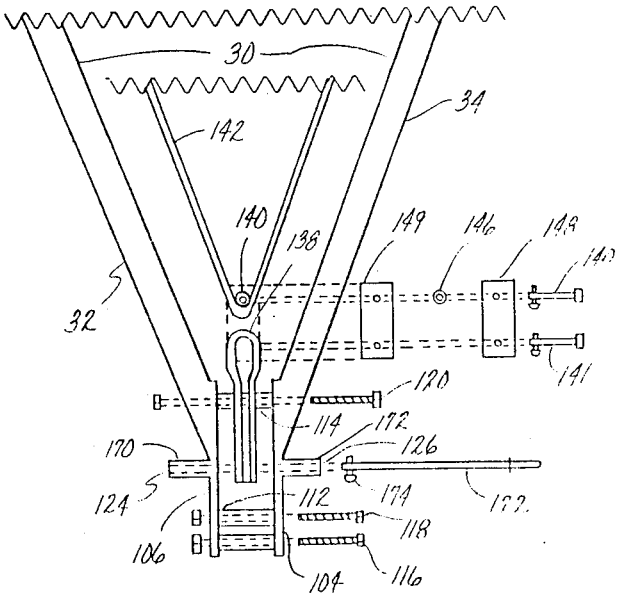
FIG. 6 is a partially exploded view of the upper end of the boom.

Referring to FIGS. 2 and 6, plate 104 is welded to the upper end of leg 34 in a spaced, parallel relationship to plate 106 that is welded to the upper end of leg 32. The two plates 106 and 108 are separated by spacer means 110, 112, and 114 welded to plate 106. Fastener means 116, 118, and 120 clamp plates 106 and 104 together. A support pin 122 is passed through two aligned openings 124 and 126 in plates 106 and 104, respectively. A retainer pin 174 is releasably fastened to the outer end of pin 122.

Referring to FIG. 1, a support 132 is pivotally suspended from the midsection of pin 122, and is adapted to support a conventional chain fall 134 having a hook 136 for raising a load (not shown) such as an engine block, or the like. The arrangement is such that as the legs are swung between their inboard and outboard positions, support 132 swings accordingly so that the load, not shown, remains beneath pin 122.

A clevis 138 is pivotally mounted on the midsection of pin 122, as illustrated in FIGS. 1 and 6, so that the clevis moves to a position according to the position of the boom legs. The clevis supports a guide roller 140.

Referring to FIG. 2, a lifting cable 142 has one end connected to an eye type anchorage 144 mounted on the cargo box. The cable passes around guide roller 140 carried on link means 148 and 149. A chain 150 is connected by a hook 152 to the cable and a conventional come-along 154 is connected by eye type anchorage 156 to the cargo box. The come-along has a handle 158 that is pivoted back and forth to either shorten or lengthen that portion of the chain 150 between the come-along and the cable, for swinging the boom between its inboard and outboard positions by a user standing on the truck bed. Eye 160 is mounted on the forward cargo box wall to assist the user in pulling a load onto the pickup bed.

Figure 7:
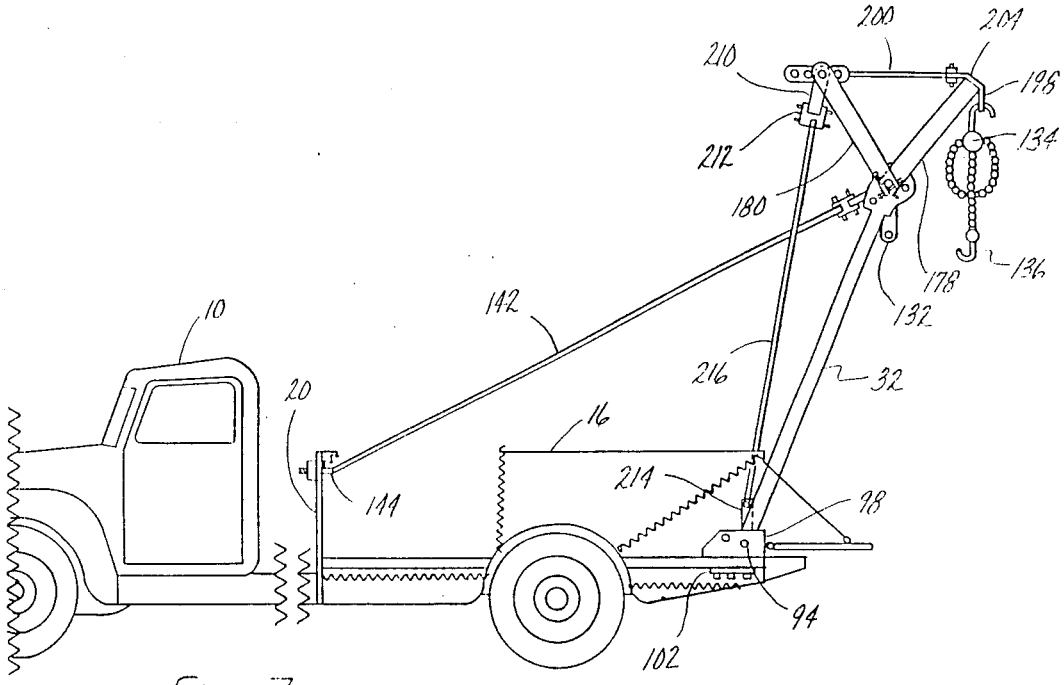
FIG. 7 is an elevational view of a jib mounted on the upper end of the boom.
Figure 8:
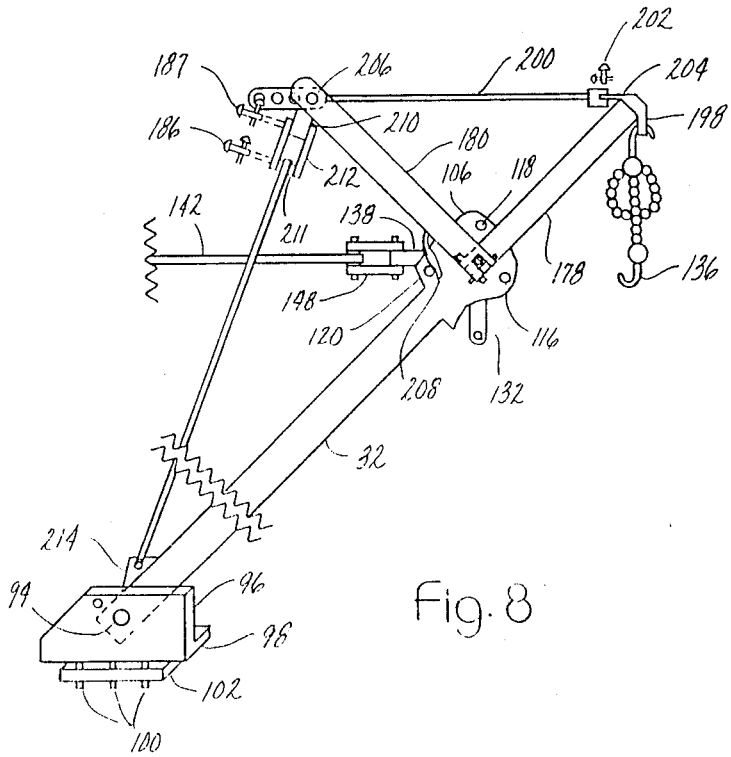
FIG. 8 is an elevational view of the jib arrangement.

FIGS. 6–8 illustrate the jib embodiment. A tubular member 170 is welded to plate 106 and has an internal bore aligned with opening 126 in plate 104. A similar tubular member 172 is welded to plate 104 with a bore aligned with opening 124 in plate 106 and opening 126. Support pin 122 is passed through the two aligned openings 124 and 126. A retainer pin 130 is inserted in an opening in the end of pin 122.

Figure 9:
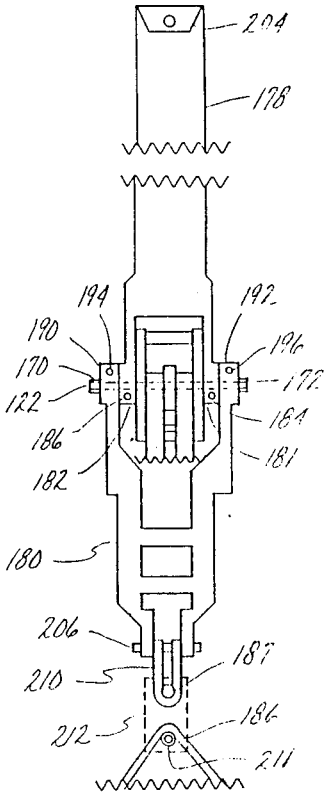
FIG. 9 is a view showing the manner in which the jib is mounted on the boom.

Referring to FIGS. 7 and 9, a jib is mounted on the upper end of the boom. The jib includes an elongated tubular jib member 178 and a post 180. Member 178 has a pair of ears 181 and 182 which receive, respectively, pins 184 and 186. The arrangement is such that the jib is pivotally mounted on tubular members 170 and 172.

Post 180, FIG. 8, has a pair of ears 190 and 192 which receive respectively pins 194 and 196. The post, as is the jib, is pivotally mounted on tubular members 170 and 172.

An apertured lip 198 depends downwardly from the outer end of the jib to provide means for hanging chain fall 134 for lifting a load and swinging it toward the truck cargo box.

An adjustable rod 200 has one end connected by pin 202 to upper end of lip 204 carried by the outer end of the jib, and its opposite end connected by a pin 206 to the upper end of post 180. The arrangement is such that the three-sided structure formed by jib member 178, post 180 and rod 200 are pivotable as a unit about tubular members tubes 170 and 172.

The upper end of boom leg 32 has a lip 208, and leg 34 has a lip (not shown) which cooperates with lip 208 to engage post 180 to limit its rotation in the counterclockwise direction as viewed in FIG. 7.

Post 180 carries a rearward extending ear 210 having a guide roller link 212.

Referring to FIG. 8, the lower end of leg 34 has a small plate (not shown) with an eye. The lower end of leg 32 has a small apertured plate 214.

Cable 216 has one end attached to plate 214, and extends up and around roller 211 in link 212 with its opposite end attached to the apertured plate carried on the lower end of leg 34. When cable 216 is in position, post 180 abuts lip 208 so that both boom legs and the jib can be raised and lowered with a load suspended beneath chain fall 134.

Thus it is to be understood that I have described a knock-down boom for a pick-up truck or other vehicle having a cargo bed which can be easily assembled or disassembled by one man in a few minutes. The two boom legs are unpinned from the truck bed and disconnected by removing pins 82 and 94 and the fasteners from the boom plates. Jib 178 is removed from the mounting tubes 170 and 172 by removing pins 194, 196, 184, and 186 and the related fasteners, and disconnecting cable 216.

FIG. 5 illustrates how the boom can be connected by a clamp 220 to the truck bed's conventional step bumper 28.

Having described my invention, I claim:

1. In association with a truck having a longitudinal centerline; said truck including a cargo box defined by a bed, a forward wall, two side walls, and a tailgate: the improvement comprising a V-shaped boom structure; means pivotally mounting said boom structure for vertical swinging movement around an axis that is transverse to the cargo box side walls in close adjacency to the rear end of the bed and lower edge of the tailgate; said boom structure having a length that is less than the distance between the pivot means and forward wall of the cargo box, whereby the boom structure can be swung forward to a storage position totally disposed within the cargo box; said boom structure comprising two convergent bars having two closely-spaced ends in near proximity to the vehicle centerline and two widely-spaced ends in near proximity to the cargo box side walls; means rigidly connecting the closely-spaced ends of said bars; said rigid connecting means comprising a plate (104 or 106) welded to an end of each bar in parallelism to the vehicle centerline, at least two transverse tubular spacers (110, 114) extending from one plate to the other plate, and threaded fastener means (116, 120) extending through the tubular spacers to rigidly but detachably connect the convergent bars; said pivot means comprising two widely-spaced foot structures detachably fastened to the bed in near adjacency to the cargo box side walls for connection to the widely-spaced ends of the convergent bars; the space between the convergent bars being unobstructed, whereby cargo can be placed therein when the boom is in its storage position.

2. The improvement of claim 1 further comprising an elongated jib means, and means swingably attaching said jib means to the parallel plates; said swingable attaching means comprising ear means extending from the jib means along outer side faces of the parallel plates, and a support pin (122) extending through the plates and ear means.

3. In association with a truck having a longitudinal centerline; said truck including a cargo box defined by a bed, a forward wall, two side walls, and a tailgate: the improvement comprising a V-shaped boom structure; means pivotally mounting said boom structure for vertical swinging movement around an axis that is transverse to the cargo box sidewalls in close adjacency to the rear end of the bed and lower edge of the tailgate; said boom structure having a length that is less than the distance between the pivot means and forward wall of the cargo box, whereby the boom structure can be swung forward to a storage position totally disposed within the cargo box; said boom structure comprising two convergent bars having two closely-spaced ends in near proximity to the vehicle centerline and two widely-spaced ends in near proximity to the cargo box side walls; means rigidly connecting the closely-spaced ends of said bars; said pivot means comprising two widely-spaced foot structures detachably fastened to the bed in near adjacency to the cargo box side walls for connection to the widely-spaced ends of the convergent bars; each foot structure comprising an anchor plate (52), first fastener means detachably fastening each anchor plate to the underside of the cargo bed, a flat wall (42) seated on the upper surface of the cargo bed directly above the anchor plate, and second threaded fastener means (50, 48) extending through the flat wall and anchor plate to detachably connect the foot structure to the cargo bed; said first fastener means, being separate from the second fastener means, whereby the flat wall can be separated from the cargo bed without removing the anchor plate; the space between the convergent bars being unobstructed, whereby cargo can be placed therein when the boom is in its storage position.

4. In association with a truck having a longitudinal centerline; said truck including a cargo box defined by a bed, a forward wall, two side walls, and a tailgate: the improvement comprising a V-shaped boom structure; means pivotally mounting said boom structure for vertical swinging movement around an axis that is transverse to the cargo box side walls in close adjacency to the rear end of the bed and lower edge of the tailgate; said boom structure having a length that is less than the distance between the pivot means and forward wall of the cargo box, whereby the boom structure can be swung forward to a storage position totally disposed within the cargo box; said boom structure comprising two convergent bars having two closely-spaced ends in near proximity to the vehicle centerline and two widely-spaced ends in near proximity to the cargo box side walls; means rigidly connected the closely-spaced ends of said bars; said pivot means comprising two widely-spaced foot structure detachably fastened to the bed in near adjacency to the cargo box sidewalls for connection to the widely-spaced ends of the convergent bars; the space between the convergent bars being unobstructed, whereby cargo can be placed therein when the boom is in its storage position, and further including means for moving the boom structure around its swing axis; said moving means including a first anchorage (144) releasably attached to the forward wall of the cargo box at an elevated point near one of its ends, a second anchorage (156) releasably attached to the forward wall of the cargo box at an elevated point near its other end, pulley means (140) connected to the aforementioned connecting means at the convergent ends of the boom structure bars, and a flexible connector means extending from the first anchorage around the pulley means to the second anchorage; said flexible connector means including a manually-operable means (154) for effectively shortening or lengthening the flexible connector means, to thereby move the boom structure.

5. The improvement of claim 4 wherein each anchorage comprises an eye structure having a threaded shank releasably extended through the forward wall of the cargo box.

* * * * *